United States Patent [19]

Ogura

[11] 4,115,666

[45] Sep. 19, 1978

[54] DISCRETE 4-CHANNEL STEREO RECORDING AND/OR REPRODUCING SYSTEM COMPATIBLE WITH MATRIX SYSTEMS

[75] Inventor: Keiichiro Ogura, Kawasaki, Japan

[73] Assignee: Nippon Columbia Kabushikikaisha, Tokyo, Japan

[21] Appl. No.: 714,131

[22] Filed: Aug. 13, 1976

Related U.S. Application Data

[63] Continuation of Ser. No. 541,992, Jan. 17, 1975, abandoned, which is a continuation of Ser. No. 364,934, May 29, 1973, abandoned.

[30] Foreign Application Priority Data

| | | | |
|---|---|---|---|
| May 30, 1972 | [JP] | Japan | 47-53622 |
| Jun. 8, 1972 | [JP] | Japan | 47-57230 |
| Jun. 8, 1972 | [JP] | Japan | 47-57232 |
| Jun. 8, 1972 | [JP] | Japan | 47-57231 |
| Jun. 15, 1972 | [JP] | Japan | 47-59844 |
| May 30, 1972 | [JP] | Japan | 47-53621 |

[51] Int. Cl.[2] ..... H04R 5/00

[52] U.S. Cl. ..... 179/100.4 ST; 179/100.1 TD; 179/1 GQ

[58] Field of Search ..... 179/100.4 ST, 100.1 TD, 179/1 GQ, 1 G, 15 BT

[56] References Cited

U.S. PATENT DOCUMENTS

| | | | |
|---|---|---|---|
| 3,686,471 | 8/1972 | Takahashi | 179/100.4 ST |
| 3,745,252 | 7/1973 | Bauer | 179/100.4 ST |
| 3,761,628 | 9/1973 | Bauer | 179/100.4 ST |
| 3,787,622 | 1/1974 | Itoh | 179/100.4 ST |
| 3,932,706 | 1/1976 | Takahashi | 179/100.4 ST |
| 3,979,564 | 9/1976 | Cho | 179/100.4 ST |

OTHER PUBLICATIONS

"Why the Four Channel War Need Not Take Place", by L. Feldman, Audio Magazine, Jul., 1972, pp. 30–31.

*Primary Examiner*—Bernard Konick
*Assistant Examiner*—Alan Faber
*Attorney, Agent, or Firm*—Hill, Gross, Simpson, Van Santen, Steadman, Chiara & Simpson

[57] ABSTRACT

A discrete 4-channel stereo recording and reproducing system which is based on a regular matrix type 4-channel stereo system and compatible with both of a regular matrix system and a CD-4 type 4-channel stereo system. In the audio frequency band, the same encoding as that in the regular matrix system is performed and, in the carrier frequency band, encoding for satisfying the compatibility with existing systems is achieved. The decoding is intended to improve the sound image location and separation in the reproduced sound field from CD-4 type stereo signals and automatic switching of a decoding circuit for the regular matrix type signals is achieved.

3 Claims, 24 Drawing Figures

Amplitude
Frequency
$T_L$
$L_F$
$L_B$
$C_L$
$T_R$
$R_F$
$R_B$
$C_R$
$f_C$

Amplitude
Frequency
$T_L$
$L_B$
$L_F$
$R_F$
$R_B$
$C_L$
$T_R$
$R_H$
$C_R$
$f_C$ $T_L$
$L_B$
$R_B$
$L_F$
$R_F$
$T_R$ $L_B$
$L_F$
$R_F$
$L_H'$
$R_F'$
$R_B$
$L_B'$
$R_B'$
$L_H$ LB
14
PHASE SHIFTER
51
θ
16
-1
LF
11
52
m
53
m
54
m
58
m
ATTENTUATORS
ADDERS
13
Σ
12
Σ
17
Mod.
18
CL
TL
15
10
OSC
22
Σ
23
Σ
ADDERS
ATTENTUATORS
RF
21
56
m
57
m
25
TR
27
Mod.
CR
28
55
-θ
PHASE SHIFTER
26
-1
PHASE INVERTER
24
RB

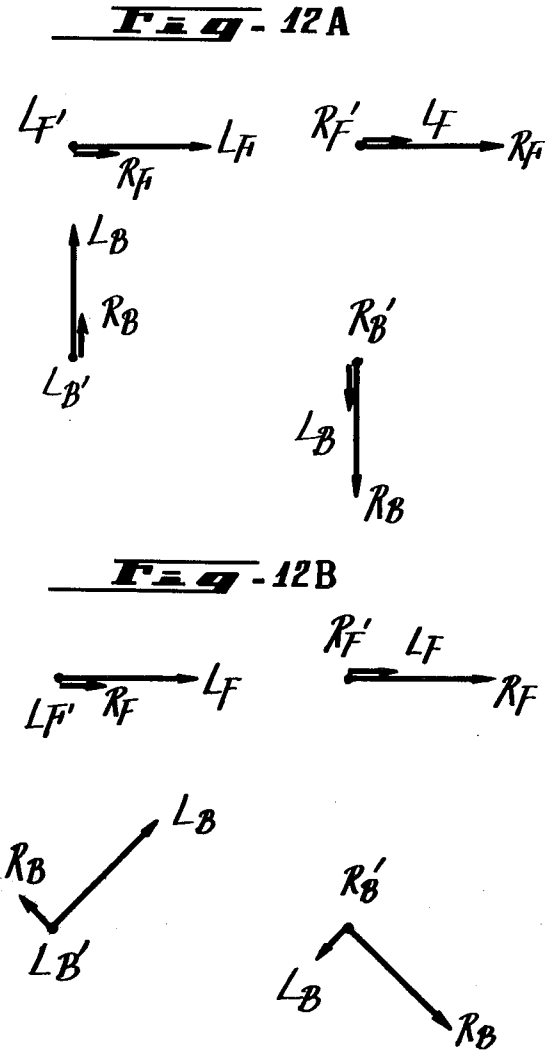
Fig - 12A
$L_F'$
$R_F$
$L_F$
$R_F'$
$R_F$
$L_B$
$R_B$
$L_B'$
$R_B'$
$R_B$
$L_B$
Fig - 12B
$L_F'$
$R_F$
$L_F$
$R_F'$
$R_F$
$L_B$
$R_B$
$L_B'$
$R_B'$
$R_B$
$L_B$
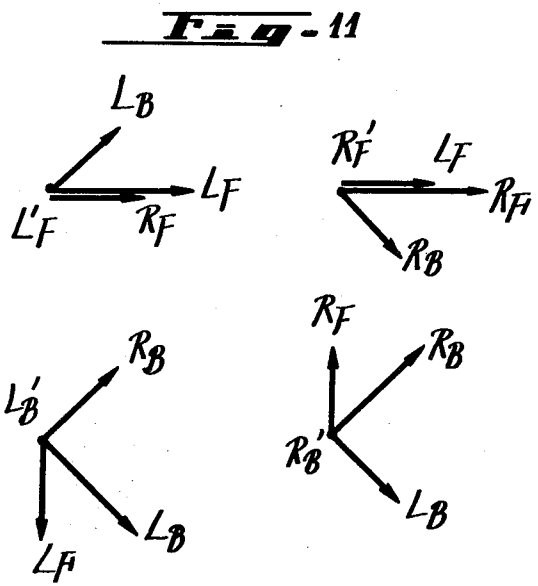
Fig - 11
$L_B$
$L_F$
$R_F$
$L_F'$
$R_F'$
$L_F$
$R_F$
$R_B$
$R_B$
$R_F$
$R_B'$
$L_B$
$R_B$
$L_B$
$L_B'$
$L_F$ $L_F'$
$R_F$
$R_B$
$L_F$
$R_F'$
$L_B$
$R_F$
$R_B$
$L_B'$
$L_B$
$R_B$
$R_B'$
$L_F$ $L_F'$
$R_F$
$R_B$
$L_F$
$R_F'$
$L_B$
$R_F$
$R_F$
$L_B'$
$R_B$
$L_B$
$R_B$
$R_B'$
$L_F$ Amplitude
Amplitude
$T_L$
$R_B$
$L_B$
$L_F$
$R_F$
$C_L$
$L_F$
$L_B$
$T_R$
$L_F$
$R_F$
$R_B$
$L_B$
$R_B$
$C_R$
$R_F$
$f_C$
Frequency
$f_C$
Frequency

DISCRETE 4-CHANNEL STEREO RECORDING AND/OR REPRODUCING SYSTEM COMPATIBLE WITH MATRIX SYSTEMS

BACKGROUND OF THE INVENTION

1. Field of the Invention

This invention relates to a multichannel audio-signal transmission systems, and more particularly to a novel multichannel autio-signal transmission system which is compatible with both of a regular matrix type system and a CD-4 type system.

2. Description of the Prior Art

In the multichannel recording and reproducing, it is known that the quality of reproduced sound field can be enhanced by increasing the number of channels and many 4-channel systems have recently been proposed.

These systems can roughly be classified into a matrix system that informtion of four individual channels is transmitted through two channels after matrix conversion and then reproduced into 4-channel information again and a discrete system that 4-channel information is transmitted through four channels and reproduced. A comparison of the two systems shows that the matrix system is low in reproduced sound image location but simple in construction. While, the discrete system has an advantage that since information of each channel is transmitted independently of that of the other channels, unnecessary information of the other channels does not get mixed in each reproduced information, and hence the feeling of presence is excellent.

At present, records manufactured according to the respective systems and reproducing apparatus designed therefore are on the market. However, since the two systems are not compatible with each other, users are required to get reproducing apparatus designed particularly for program sources of each system, and hence compelled to a heavy disbursement. Further, it is troublesome to selectively employ reproducing apparatus (change over its switch) in accordance with the particular system of a program to be reproduced and this is a cause of arresting popularization of the so-called 4-channel stereo system.

SUMMARY OF THE INVENTION

One object of this invention is to provide a novel multichannel source signal transmission system which is compatible with both of the conventional discrete and matrix reproducing systems to overcome the aforesaid defects experienced in the past.

Another object of this invention is to provide a novel reproducing system which is compatible with signal systems of this invention and the conventional discrete and matrix systems.

Another object of this invention is to provide an encoding system with which it is possible to obtain acoustic-psychologically the same sound image location regardless of whether a decoder of the discrete system or that of the matrix system is used in the novel multichannel sound signal transmission system of this invention.

Another object of this invention is to provide a decoding system that the amount of signal phase shift during decoding is selected to be closed that of either of the discrete and matrix system which has a higher degree of compatibility than the other, so as to provide for enhanced characteristic for conventional discrete system signals.

Still another object of this invention is to provide a decoding system which enables sufficient separation of conventional discrete system signals as is the case with signals of this invention reproducing system, thereby to provide a satisfactory 4-channel effect.

Other objects, features and advantages of this invention will become apparent from the following description taken in conjunction with the accompanying drawings.

BRIEF DESCRIPTION OF THE DRAWINGS

FIG. 11 shows a series of reproduced signal vector diagrams of RMC signals by an RM decoder;

FIGS. 12A and 12B show a series of reproduced signal vector diagrams of RMC signals by the CD-4-decoder;

DESCRIPTION OF THE PREFERRED EMBODIMENTS

Figure 1:
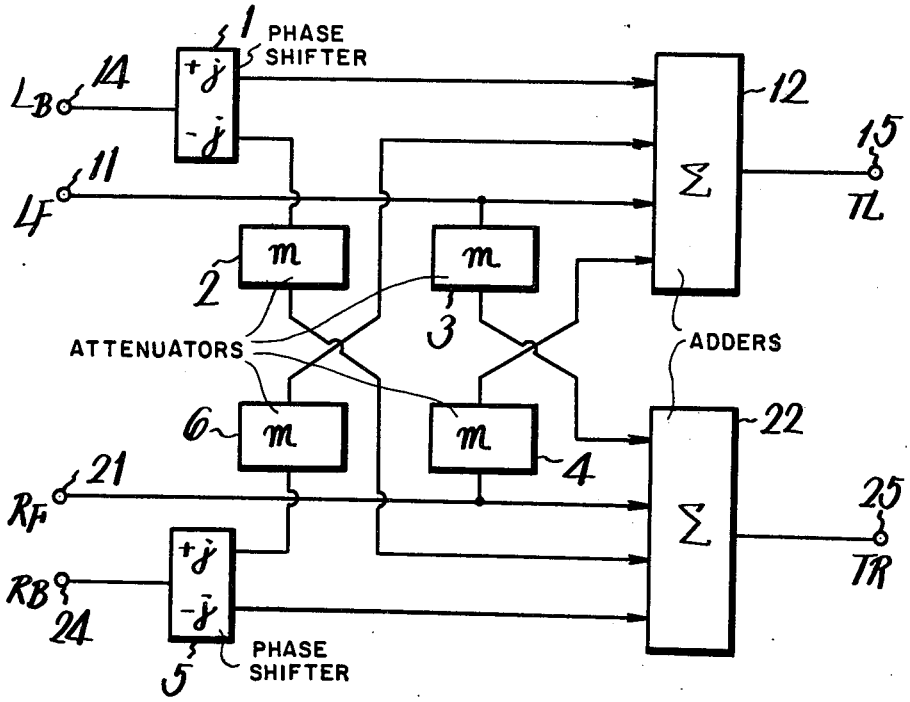
Fig. 1 PRIOR ART
FIG. 1 is a block diagram illustrating one example of an encoder for use in the conventional regular matrix 4-channel system.
Figure 2:
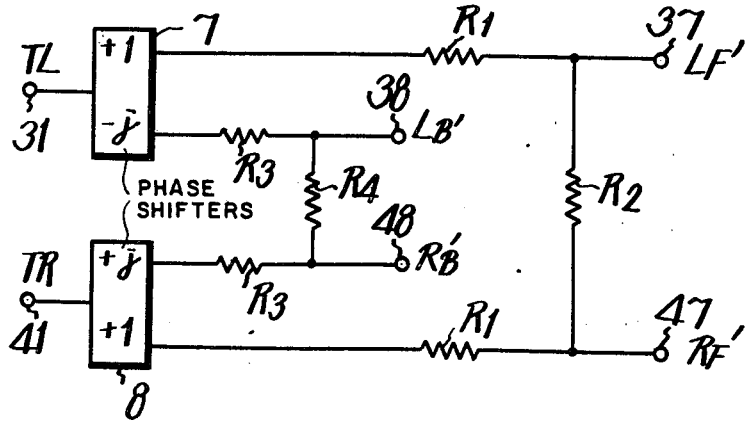
Fig. 2 PRIOR ART
FIG. 2 is a block diagram showing one example of a decoder for use in the regular matrix system.

To facilitate a better understanding of this invention, a brief description will be given first of the conventional regular matrix system (hereinafter referred to as an RM system) and discrete system (hereinafter referred to as a CD-4 system).

In the regular matrix system, it is a general rule in encoding that the signals corresponding to the front sound source of original sound field to distribbuted to one transmission signal $T_L$, composed mainly of left side signals of original sound field, and to the other transmission signal $T_R$, composed mainly of right side signals of original sound field, in the same phase, that the signals corresponding to the rear sound source of original sound field be distributed to $T_L$ in 90° advanced phase against the front signal and to $T_R$ in 90° delayed phase, and that signals to be positioned at the left in reproduced sound field be distributed more to $T_L$ than $T_R$ and those to be positioned at the right, more to $T_R$ that $T_L$.

It is a basic composition is decoding that the output signals from $T_L$ and $T_R$ are applied in the same phase to front speakers in reproduction sound field, and to rear speakers the signals from $T_L$ and $T_R$ are applied in 90° advanced and delayed phase respectively against the front signals. A composition with phase shifting greater or less than 90° is also covered by the definition but even in this case $T_L$ and $T_R$ should have reverse phases. It is also a basic composition that the output signals applied to left speakers have more $T_L$ factor than $T_R$ and those to right speakers, more $T_R$ than $T_L$.

Encoding and decoding of the RM system in a matrix form are as follows:

$$\begin{pmatrix} T_L \\ T_R \end{pmatrix} = \begin{pmatrix} j & 1 & m & mj \\ -mj & m & 1 & -j \end{pmatrix} \cdot \begin{pmatrix} L_B \\ L_F \\ R_F \\ R_B \end{pmatrix} \quad (1)$$

$$\begin{pmatrix} L_{B'} \\ L_{F'} \\ R_{F'} \\ R_{B'} \end{pmatrix} = \begin{pmatrix} -j & mj \\ 1 & m \\ m & 1 \\ -mj & j \end{pmatrix} \cdot \begin{pmatrix} T_L \\ T_R \end{pmatrix} \quad (2)$$

where $m$: the distribution ratio between the amount of input signals which are distributed to the transmission signals $T_L$ and $T_R$, or the composition ratio between the amount of transmission signals $T_L$ and $T_R$ which are contained in the output signals from the decoder on the assumption that a larger one of the input signals is taken as 1.

$L_B$: an input signal corresponding to left rear sound source in the original sound field;

$L_F$: a signal corresponding to left front sound source in the original sound field;

$R_F$: an input signal corresponding to right front sound source in the original sound field;

$R_B$: an input signal corresponding to right rear sound source in the original sound field;

$L_{B'}$: an output signal from decoder supplied to left rear speaker in the reproduced sound field;

$L_{F'}$: an output signal from decoder supplied to left front speaker in the reproduced sound field;

$R_{F'}$: an output signal from decoder supplied to right front speaker in the reproduced sound field;

$R_{B'}$: an output signal from decoder supplied to right rear speaker in the reproduced sound field;

Further, $+j$ and $-j$ represent phases advanced and delayed 90° relative to $+1$ respectively.

It is easy for those skilled in the art to embody an encoder and

The RM encoder shown in FIG. 1 has four input terminals 11, 14, 21, and 24 to which the four signals $L_F$, $L_B$, $R_F$, and $R_B$, depicted as phase and of equal amplitude, are respectively applied.

The full $L_F$ signal, the full $L_B$ signal with the phase-shift of 90° by passing through a phase-shifter 1, the $R_F$ signal with the decreased amplitude of factor $m$ ($0<m<1$) by passing through an attenuator 4 and the $R_B$ signal with the phase-shift of 90° and with the decreased amplitude of factor m by passing through a phase-shifter 5 and an attenuator 6 are applied together to an adder 12. The signal appearing at the terminal 15 is a left transmission signal designated $T_L$.

Similarly, but with the phase-shift of −90° which provides in phase-shifters 1 and 5, the output signal of an adder 22 is a right transmission signal designated $T_R$.

Figure 3:
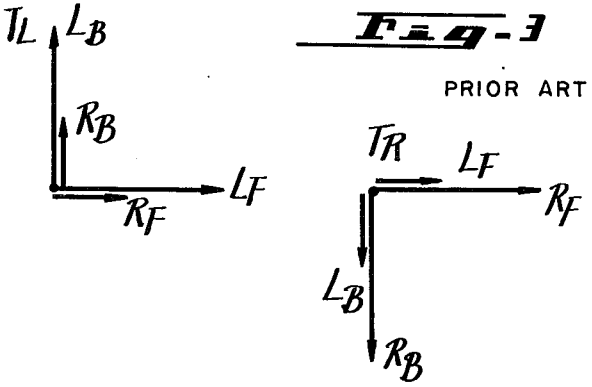
Fig-3 PRIOR ART
FIG. 3 is a vector diagram of encoding in the regular matrix system.

The decoder shown in FIG. 3 includes a pair of input terminals 31 and 41 to which the transmission signals $T_L$ and $T_R$ are respectively applied. The $T_L$ signal is applied to and phase-shifted of +90° and −90° by a phase-shifter 7, and the $T_R$ signal is applied to and phase-shifted of +90° and −90° by a phase-shifter 8. The output signals from these phase-shifters are applied to two matrixing networks which consist of three resistors, respectively, and their resistance values are chosen as satisfying the equation (2). Resulting of described phase-shifting and matrixing, four decoded signals designated $L_F'$, $L_B'$, $R_F'$, and $R_B'$ appear at the output terminals 37, 38, 47, and 48.

The composite matrix of the RM system is obtained by substituting the equation (1) into the equation (2). Rearranging it by using $m = \tan 22.5° = \sqrt{2}-1$, it is expressed by the following equation:

$$\begin{pmatrix} L_{B'} \\ L_{F'} \\ R_{F'} \\ R_{B'} \end{pmatrix} = \begin{pmatrix} \sqrt{2} & -j & 0 & 1 \\ j & \sqrt{2} & 1 & 0 \\ 0 & 1 & \sqrt{2} & -j \\ 1 & 0 & j & \sqrt{2} \end{pmatrix} \cdot \begin{pmatrix} L_B \\ L_F \\ R_F \\ R_B \end{pmatrix} \quad (3)$$

Figure 4:
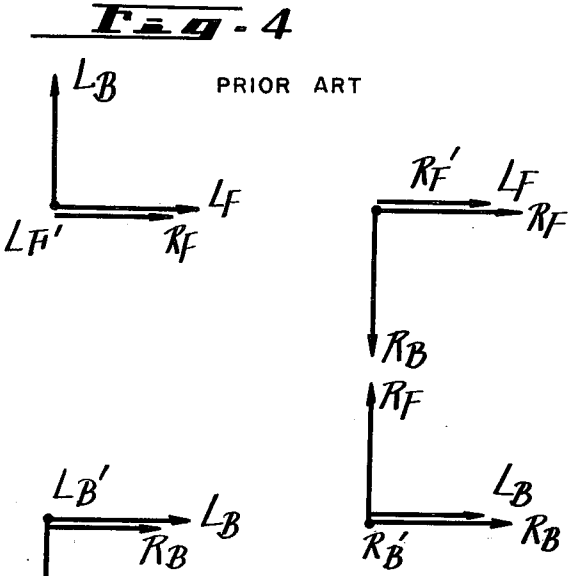
Fig-4 PRIOR ART
FIG. 4 shows a series of vector diagrams of reproduced signals of the regular matrix system.

The encoding an reproduced output signals given by the equations (1) and (3) respectively are shown in vector form in FIGS. 3 and 4 respectively.

Figure 5:
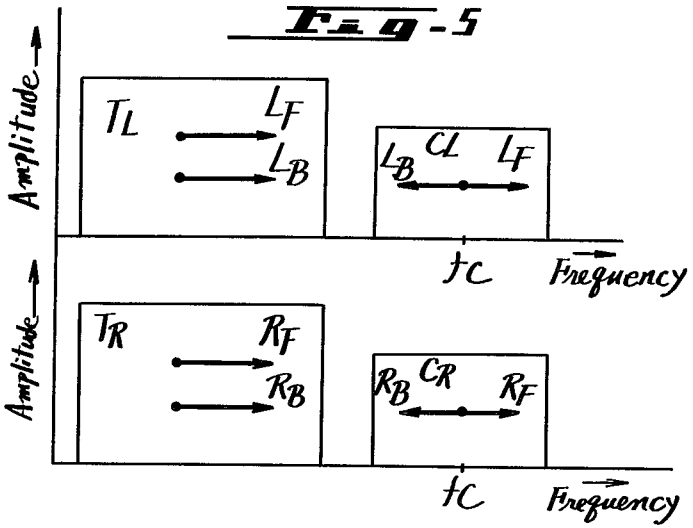
FIG. 5 shows the construction of an encoded signal of the CD-4 -system.
Figure 6:
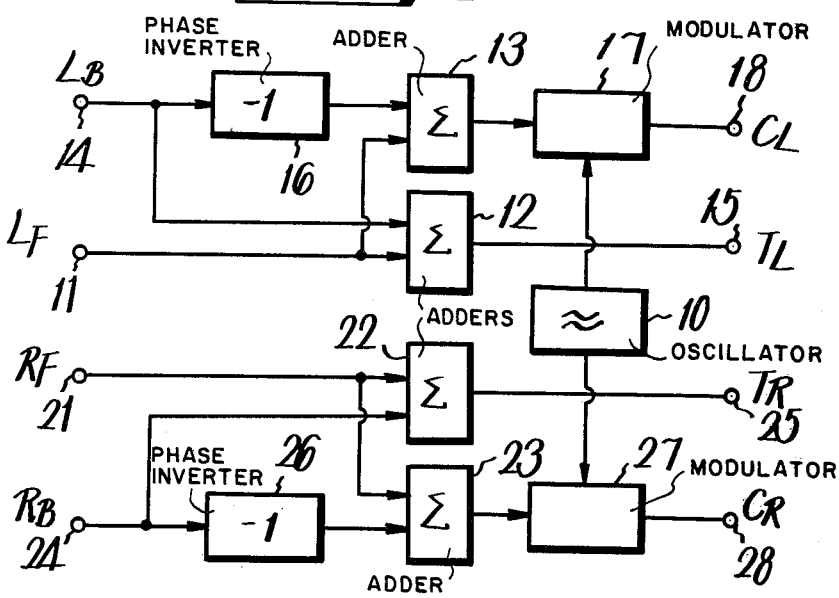
PRIOR ART Fig. 6
FIG. 6 is a block diagram illustrating one example of an encoder of the CD-4 system.

The signal construction of each channel of the CD-4 system is deqicted in FIG. 5 and a system diagram of an encoder for obtaining such CD-4 signals is shown in FIG. 6.

In the original sound field, a left front signal $L_F$ is added to adders 12 and 13 through an input terminal 11 and a left rear signal $L_B$ supplied to an input terminal 14 is divided into two: the one is applied to the adder 12 and the other is applied to the adder 13 after reversed in phase by a phase inverter 16. The output from the adder 12 is a left side transmission signal $T_L$, which is a signal of the sum combination of the signals $L_F$ and $L_B$. The output signal from the adder 13 is a signal of the difference combination of the signals $R_F$ and $L_B$, which is applied to an angular modulator 17 to modulate a carrier fc produced by an oscillator 10, providing a left carrier signal $C_L$.

In a similar manner, a right front signal $R_F$ is supplied to adders 22 and 23 through an input terminal 21 and a right rear signal $R_B$ applied to an input terminal 24 is divided into two : the one is applied to the adder 22 and the other is fed to the adder 23 after reversed in phase by a phase inverter 23. The output from the adder 22 is a right side transmission signal $T_R$, which is a signal of the sum combination of the signals $R_F$ and $R_B$. The output from the adder 23 is a signal of the difference combination of the signals $R_F$ and $R_B$, which is impressed to an angular modulator 27 to modulate the carrier fc produced by the oscillator 10, providing a right carrier signal $C_R$.

The both transmission signals $T_L$ and $T_R$ have an audio frequency band from 30 to 15,000 Hz, and the both carrier signals have a supersonic frequency band from 20 to 45 KHz with the appropriate low-pass and bandpass filters.

The left composite signal $(T_L + C_L)$ and the right composite signal $(T_R + C_R)$ are applied to the left and right input terminals of a 45-45 stereophonic cutter (not shown in diagram) to record on the two walls of the disc groove in a manner similar to that used in making a conventional stereophonic disc.

An expression of the above encoding, with the procedure for modulating the carriers being omitted, is as follows:

$$\begin{pmatrix} T_L \\ T_R \\ C_L \\ C_R \end{pmatrix} = \begin{pmatrix} 1 & 1 & 0 & 0 \\ 0 & 0 & 1 & 1 \\ -1 & 1 & 0 & 0 \\ 0 & 0 & 1 & -1 \end{pmatrix} \cdot \begin{pmatrix} L_B \\ L_F \\ R_F \\ R_B \end{pmatrix} \quad (4)$$

Figure 7:
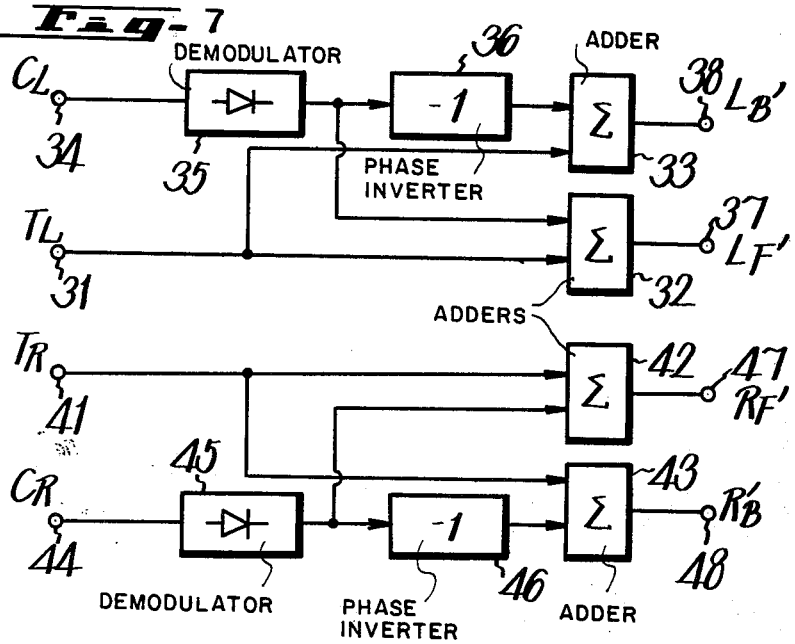
Fig. 7 PRIOR ART
FIG. 7 is a block diagram showing one example of a decoder of the CD-4 system.

In FIG. 7, there is illustrated a system diagram of a decoder by means of which are derived from the aforesaid CD-4 signal four signals making up the reproduced sound field. The stereophonic phonograph pick-up, having a good frequency response up to about 45 KHz, reproduces the left composite signal $(T_L + C_L)$ and the right composite signal $(T_R + C_R)$ at its left and right output terminals, respectively. These composite signals are amplified and then separated into the left transmission signal $T_L$, the right transmission signal $T_R$, the left carrier signal $C_L$ and the right carrier signal $C_R$ by means of appropriate low-pass and band-pass filters. The left transmission signal $T_L$ is applied to an input terminal 31 and divided into two and fed to adders 32 and 33. The left carrier signal $C_L$ supplied to an input terminal 34 is demodulated by on angular demodulator 35 and then divided into two: the one is fed to the adder 32 and the other is fed to the adder 33 after reversed in phase by a phase inverter 36. The adder 32 derives therefrom a left front output signal $L_F'$ at an output terminal 37 and the adder 33 dervies therefrom a left rear output signal $L_B'$ at an output terminal 38. In a like manner, the right transmission signal $T_R$ is applied to an input terminal 41, divided into two and then supplied to adders 42 and 43, while, the right carrier signal $C_R$ fed to an input terminal 44 is demodulated by an angular demodulator 45 and divided into two: the one is applied to the adder 42 and the other is fed to the adder 43 after reversed in phase by a phase inverter 46. The adder 42 derives therefrom a right front output signal $R_F'$ at an output terminal 47 and the adder 43 derives therefrom a right rear output signal $R_B'$ at an output terminal 48.

An expression of the above decoding, with the procedure for demodulating the carrier signals being omitted, is as follows:

$$\begin{pmatrix} L_{B'} \\ L_{F'} \\ R_{F'} \\ R_{B'} \end{pmatrix} = \begin{pmatrix} 1 & 0 & -1 & 0 \\ 1 & 0 & 1 & 0 \\ 0 & 1 & 0 & 1 \\ 0 & 1 & 0 & -1 \end{pmatrix} \cdot \begin{pmatrix} T_L \\ T_R \\ C_L \\ C_R \end{pmatrix} \quad (5)$$

Substituting the equation (5) into the equation (4), the composite matrix becomes such a diagonal matrix as given by the following equation:

$$\begin{pmatrix} L_{B'} \\ L_{F'} \\ R_{F'} \\ R_{B'} \end{pmatrix} = \begin{pmatrix} 2 & 0 & 0 & 0 \\ 0 & 2 & 0 & 0 \\ 0 & 0 & 2 & 0 \\ 0 & 0 & 0 & 2 \end{pmatrix} \cdot \begin{pmatrix} L_B \\ L_F \\ R_F \\ R_B \end{pmatrix} \quad (6)$$

From the above, it is known that the CP-4 system is discrete.

A comparision of th4e encoding and decoding operations of the RM and CD-4 systems showns that the RM system includes the term $j$ and a 90° phase shift but is based only on the addition and subtraction of the respective signal components.

Based on this point, the present invention has for its object to provide a novel multichannel audio signal transmission system which is compatible with both of the RM and CD-4 systems.

The system of this invention will be hereinafter called regular matrix base discrete system (hereinafter referred to as RMD system) and one examples of its embodiments will hereinafter be referred to as an RMC system.

Figure 8:
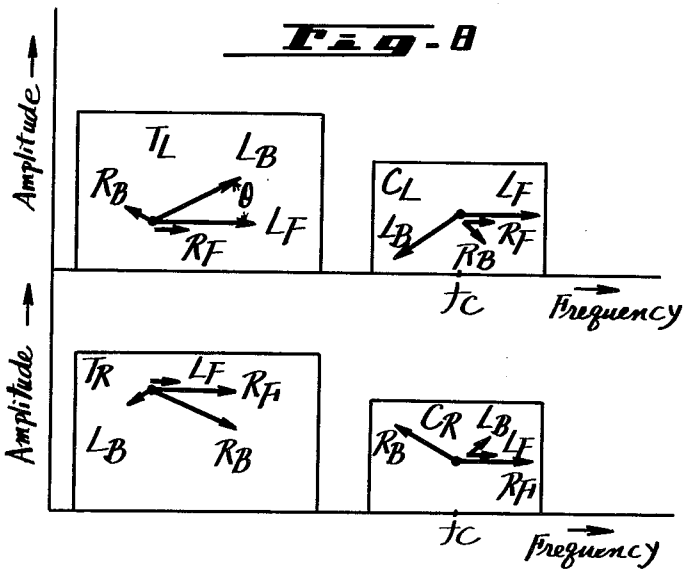
FIG. 8 shows the signal construction in encoding of the RMC system embodying this invention.

The signal constructions of the RMC system are such as depicted in FIG. 8. The first and second transmission signals $T_L$ and $T_R$ and the first and second carrier signals $C_L$ and $C_R$ are encoded from the input sound signal in the audio-frequency and high-frequency bands respectively. The carrier signals $C_L$ and $C_R$ are signals obtained by modulating the carrier fc, so that they must be demodulated prior to decoding as in the case of the CD-4 system but this is not essential to the description of the encoding and decoding of this invention system, and accordingly no description of encoding and decoding will be given of the modulation and demodulation.

The encoding of the RMC system is given in matrix form as follows:

$$\begin{pmatrix} T_L \\ T_R \\ C_L \\ C_R \end{pmatrix} = \begin{pmatrix} A & 1 & m & -m\bar{A} \\ -mA & m & 1 & \bar{A} \\ -A & 1 & m & m\bar{A} \\ mA & m & 1 & -\bar{A} \end{pmatrix} \cdot \begin{pmatrix} L_B \\ L_F \\ R_F \\ R_B \end{pmatrix} \quad (7)$$

where $A = e^{j\theta}$ and $\bar{A} = e^{-j\theta}$. This implies that if the front input sound signal distributed in phase in the both transmission signals is considered as a reference axis, inspection of the vector diagram of the RMC signals, as shown in FIG. 8, will be shown that these unit vectors A and A, on which two rear input signals $L_B$ and $R_B$ are placed, respectively, are the mirror image of each other. In other words, A and $\bar{A}$ represent the amounts of phase shift of the rear input signal at the time of encoding.

Figure 9:
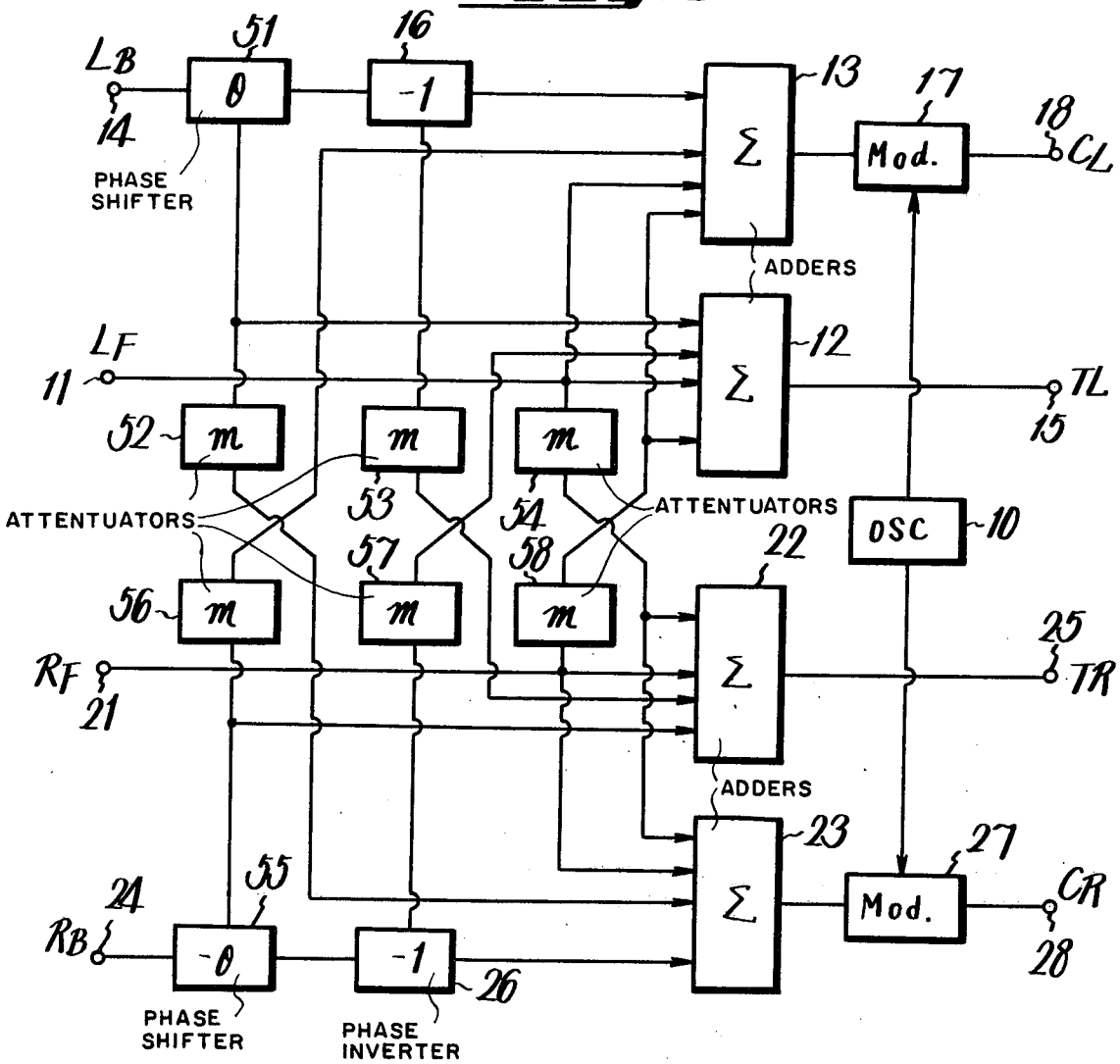
FIG. 9 is a block diagram illustrating one example of an encoder of the RMC system.

It is easy for those skilled in the art to obtain a concrete encoder from the equation (7), one example of which is illustrated in FIG. 9. Since it is similar in construction to the aforesaid CD-4 encoder, parts corresponding to those in the latter are marked with the same reference numerals.

In FIG. 9, reference numerals 51 and 55 designate phase shifters, which correspond to the unit vectors A and $\bar{A}$ respectively. Reference numerals 52, 53, 54, 56, 57 and 58 identify attenuators. The full $L_F$ signal, the full $L_B$ signal with a phase-shift of 0 by passing through a phase-shifter 51, the $R_F$ signal with a decreased amplitude of factor m by passing through an attenuator 58, and the $R_B$ signal with a decreased amplitude of factor m and a phase-shift of $-(-\theta)$ by passing through an attenuator 57, a phase-shifter 55 and a phase-inverter 26 are applied together to an adder 12. The signal appearing at the output terminal 15 is a left transmission signal designated $T_L$.

The full $L_F$ signal, the full $L_B$ signal with a phase-shift of $-\theta$ by passing through a phase-shifter 51 and a phase-inverter 16, the $R_F$ signal with a decreased amplitude of factor m by passing through an attenuator 58, and the $R_B$ signal with a decreased amplitude of factor m and a phase-shift of $-\theta$ by passing through an attenuator 56 and a phase-shifter 55 are applied together to an adder 13. The output signal of said adder 13 is applied to an angular-modulator 17 in order to modulate a carrier $f_c$ supplied from an oscillator 10. The signal appearing at the output terminal 18 is the left carrier signal designated $C_L$.

Similarly, four input signals $L_F$, $L_B$, $R_F$, and $R_B$ having proper amplitude and phase are applied together to both adders 22 and 23. The signal appearing at the output terminal 25 is the right transmission signal $T_R$. The output signal of an adder 23 is applied to an angular-modulator 27 in order to modulate a carrier $f_c$ supplied from an oscillator 10. The signal appearing at the output terminal 28 is a right carrier signal $C_R$.

Having proper band-width by passing through appropriate lowpass and band-pass filters, these $T_L$, $T_R$, $C_L$, and $C_R$ signals make the left composite signal $(T_L + C_L)$ and the right composte signal $(T_R + C_R)$ as shown in FIG. 8. These composite signals are applied to the left and right input terminals of a stereophonic cutter to record on the two walls of the disc groove in a manner similar to that used in making a conventional stereophonic disc.

This RMC system is a novel discrete system and the composite matrix is a diagonal one as given by the aforesaid equation (6) and its decode matrix is opposite to the encode matrix expressed by the equation (7) and expressed as follows:

$$\begin{pmatrix} L_{B'} \\ L_{F'} \\ R_{F'} \\ R_{B'} \end{pmatrix} = \begin{pmatrix} \bar{A} & m\bar{A} & -\bar{A} & -m\bar{A} \\ 1 & -m & 1 & -m \\ -m & 1 & -m & 1 \\ mA & A & -mA & -A \end{pmatrix} \cdot \begin{pmatrix} T_L \\ T_R \\ C_L \\ C_R \end{pmatrix} \quad (8)$$

It appears from the above equation (8) that the rear output signals are combined by the both transmission signals with the both carrier signals while being phase shifted in the same amount as that for the rear input signal at the time of encoding.

Figure 10:
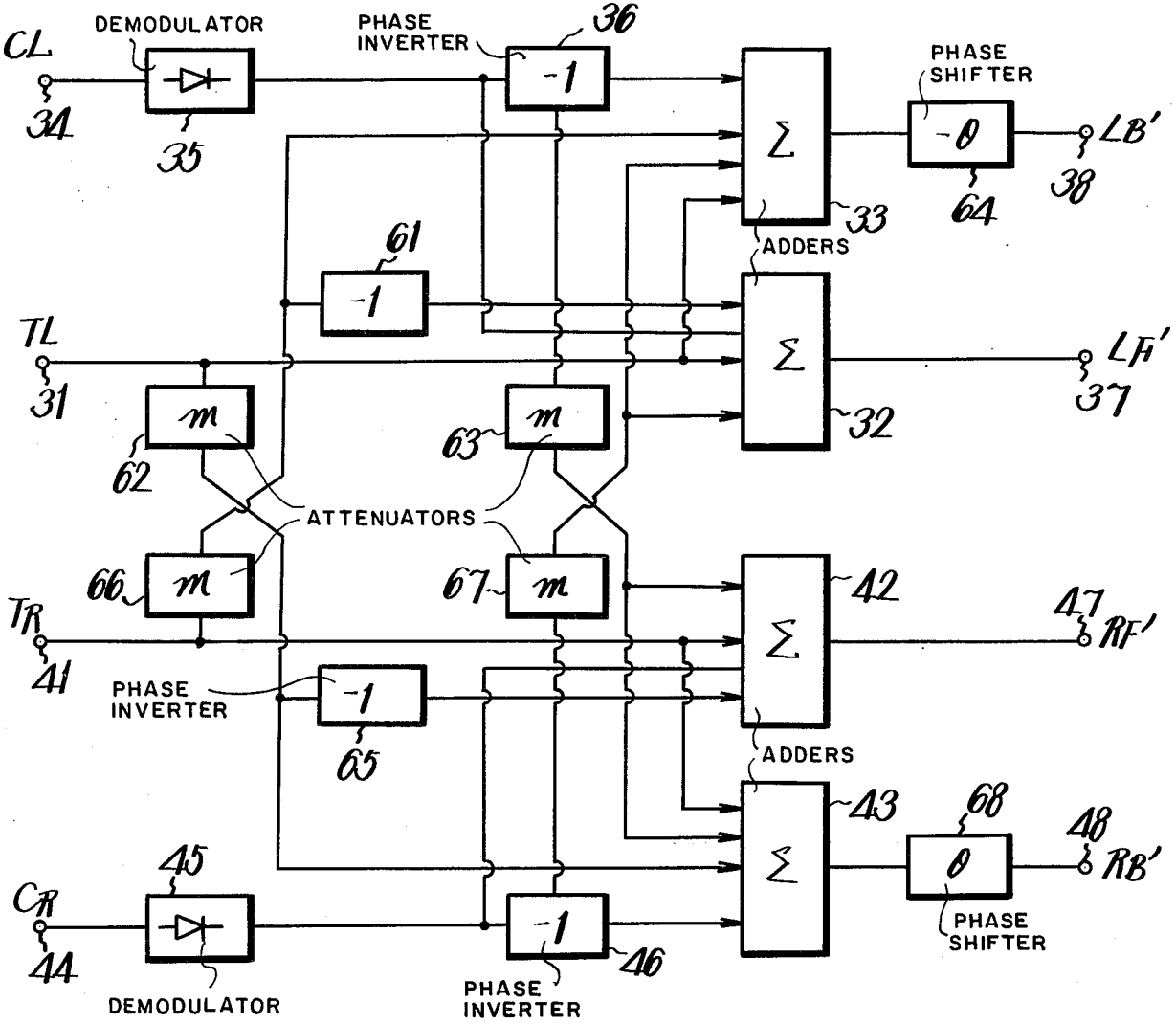
FIG. 10 is a block diagram illustrating one example of a decoder of the RMC system.

In FIG. 10 there is illustrated a decoder constructed on the basis of the above equation (8). Since this is similar in construction to the aforementioned CD-4 decoder, parts corresponding to those in the latter are identified by the same reference numerals. In FIG. 10, reference numerals 61 and 65 indicate phase inverters, 62, 63, 66 and 67 attenuators and 64 and 68 phase shifters. In like manner to the CD-4 decoder, the stereophonic phonograph pick-up, having a good frequency response, reproduces the left composite signal $(T_L + C_L)$ and the right composite signal $(T_R + C_R)$ at its left and right output terminals, respectively. These composite signals are amplified and then separated into the left transmission signal $T_L$, the right transmission signal $T_R$, the left carrier signal $C_L$ and the right carrier signal $C_R$ by means of appropriate low-pass and band-pass filters. The left transmission signal $T_L$ is applied to an input terminal 31 and divided into three and fed to adders 32, 33, and an attenuator 62. The reduced signal $T_L$ at the output of said attenuator 62 is divided into two parts and one is applied directly to an adder 43, and another is fed to an adder 42 with the inverted phase by passing through a phase-inverter 65. The left carrier signal $C_L$ applied to an input terminal 34 is demodulated by an angular-demodulator 35 and then divided into two: the one is fed to the adder 32 and the other is fed to the adder 33 after inverted by a phase-inverter 36. The output of the phase-inverter 36 is applied to the adders 42 and 43 after reduced in amplitude by an attenuator 63. Similarly, the right transmission signal $T_R$ applied to an input terminal 41 is fed to the adders 42 and 43 and an attenuator 66. With reduced amplitude, the output of the attenuator is divided into two: the one is fed to the adder 33 and the other is fed to the adder 32 after inverted in phase by a phase-inverter 61. The right carrier signal $C_R$ applied to an input terminal 44 is demodulated by an angular-demodulator 45 and then divided into two: the one is applied to an adder 42 and the other is applied to an adder 43 after inverted in phase by a phase-inverter 46. The output of the phase-inverter 46 is also applied to the adders 32 and 33 with the reduced amplitude by passing through an attenuator 61. The adders 33 and 42 derive therefrom the left front output signal $L_F'$ and the right front output signal $R_F'$, respectively. Shifted in phase of $-\theta$ by a phase-shifter 64, the derived signal from the adder 33 is the left rear output signal $L_B'$, similarly, shifted in phase of $+\theta$ by a phase-shifter 68, the derived signal from the adder 43 is the right rear output signal $R_B'$.

The following will describe, by algebraic expressions and drawings, that this invention system is compatible with the conventional RM and CD-4 systems. For the sake of brevity, only an operation of the product of the decode matrix and the encode matrix is shown.

Adding the RMC signal of the equation (7) to the RM decoder of the equation (2), the resulting output signal matrix is as follows:

$$\begin{bmatrix} -j & mj \\ 1 & m \\ m & 1 \\ -mj & j \end{bmatrix} \cdot \begin{bmatrix} A & 1 & m & -m\bar{A} \\ -mA & m & 1 & \bar{A} \\ -A & 1 & m & mA \\ mA & m & 1 & -\bar{A} \end{bmatrix}$$

Rearranging the above substituting $m = \sqrt{2} - 1$ usually employed into it, it is as follows:

$$\begin{bmatrix} -\sqrt{2jA} & -j & 0 & j\bar{A} \\ A & \sqrt{2} & 1 & 0 \\ 0 & 1 & \sqrt{2} & \bar{A} \\ -jA & 0 & j & \sqrt{2j\bar{A}} \end{bmatrix} \quad (9)$$

where $A = e^{j\theta}$ and $\bar{A} = e^{-j\theta}$. It will be apparent that, for example, if $\theta = 90°$, the equation (9) becomes identical with the aforementioned equation (3) to provide the same output signal as that obtained in the case of adding the RM signal.

Where $\theta = 45°$, the output signal is such as depicted in FIG. 11 and the RM signal output and the rear signal are different in phase from each other only and the compatibility is apparent.

Adding the RMC signal of the equation (7) to the CD-4 decoder of the equation (5), the resulting output signal matrix is as follows:

$$\begin{bmatrix} 1 & 0 & -1 & 0 \\ 1 & 0 & 1 & 0 \\ 0 & 1 & 0 & 1 \\ 0 & 1 & 0 & -1 \end{bmatrix} \cdot \begin{bmatrix} A & 1 & m & -m\bar{A} \\ -mA & m & 1 & \bar{A} \\ -A & 1 & m & m\bar{A} \\ mA & m & 1 & -\bar{A} \end{bmatrix} = \begin{bmatrix} A & 0 & 0 & -mA \\ 0 & 1 & m & 0 \\ 0 & m & 1 & 0 \\ -mA & 0 & 0 & \bar{A} \end{bmatrix} \quad (10)$$

The CD-4 decoder outputs of the RMC signal in the cases of $\theta = 90°$ and $\theta = 45°$ are such as depicted in FIGS. 12A and 12B respectively. In the case of $\theta = 90°$, the $L_B$ output signal and the $R_B$ output signal are reverse in phase, so that the rear sound image cannot be located. In order to bring them is phase with the front signals, it is necessary to delay and advance them 90° respectively. In the case of $\theta = 45°$, the phase difference between the rear output signals is 90° and if $m = \geqq 2-1$, separation is 7.7dB and it is possible to obtain and appreciably high degree of 4-channel effect.

Supplying the CD-4 signal of the equation (4) to the RMC decoder of the equation (8), the resulting output signal matrix is as follows:

$$\begin{bmatrix} \bar{A} & m\bar{A} & -\bar{A} & -m\bar{A} \\ 1 & -m & 1 & -m \\ -m & 1 & -m & 1 \\ mA & A & -mA & -A \end{bmatrix} \cdot \begin{bmatrix} 1 & 1 & 0 & 0 \\ 0 & 0 & 1 & 1 \\ -1 & 1 & 0 & 0 \\ 0 & 0 & 1 & -1 \end{bmatrix} = \begin{bmatrix} \bar{A} & 0 & 0 & m\bar{A} \\ 0 & 1 & -m & 0 \\ 0 & -m & 1 & 0 \\ mA & 0 & 0 & A \end{bmatrix} \quad (11)$$

Since the CD-4 system and the RMC system are both discrete, the aforesaid equations (10) and (11) become reverse matrixes. Accordingly, if the matrix circuit expressed by the equation (11) is employed for correcting an location of the rear sound image in such a reproduced sound field as expressed by the equation (1), the resultant matrix becomes follows:

$$\begin{bmatrix} 1-m^2 & 0 & 0 & 0 \\ 0 & 1-m^2 & 0 & 0 \\ 0 & 0 & 1-m^2 & 0 \\ 0 & 0 & 0 & 1-m^2 \end{bmatrix}$$

from which it appears that discrete reproduction is effected. The product of the CD-4 decode matrix and the correcting matrix is the RMC decode matrix of the equation (8).

A simple correcting matrix which is obtained by $A = 1$ and $\bar{A} = 1$ in the equation (11) and does not include any phase shift term is also useful.

Figures 13A, 13B, 14:
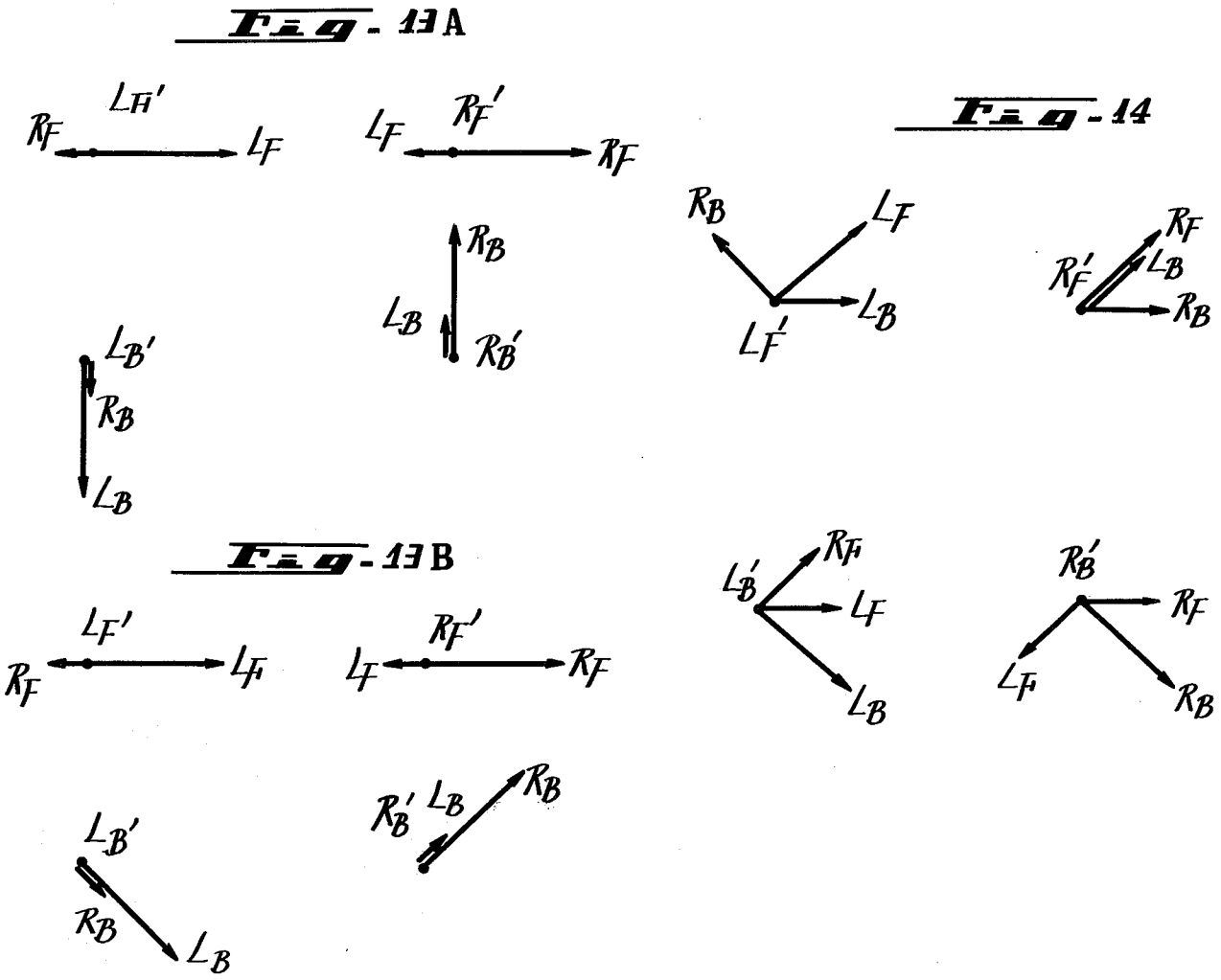
FIGS. 13A and 13B show a series of reproduced signal vector diagrams of CD-4 -signals by the RMC decoder.
FIG. 14 shows a series of reproduced signal vector diagrams of RM signals by the RMC decoder (modified)

Applying the CD-4 signal to the RMC decoder, its output signal is such as given by the equation (11) and in the cases of $\theta = 90°$ and $\theta = 45°$, it becomes as depicted in FIGS. 13A and 13B respectively. In the case of $\theta = 90°$, the left and right rear signals are opposite in phase to each other and the rear sound image is not located. In order to make them in phase with the front signals, they must be delayed and advanced 90° respectively. In the case of $\theta = 45°$, the phase difference between the left and right signals is 90° and if $m = \sqrt{2}-1$, separation is 7.7dB and the 4-channel effect can be fairly enhanced.

From the discussion of the CD-4 correcting decode matrix, it will be easily understood that a reverse-correction matrix required at the time of applying the CD-4 signal to the RMC decoder is that given by the equation (10). Further, a simple reverse correction matrix obtainable with $A = 1$ and $\bar{A} = -1$ in the equation (10) is also useful.

The above-described correction matrixes can be obtained by employing one part of the RM decoder built in a combined RM and CD-4 system reproducer.

The output signal matrix obtainable with the application of the RM 2−1, RMC decoder is as follows:

$$\begin{bmatrix} \bar{A} & m\bar{A} & -\bar{A} & -m\bar{A} \\ 1 & -m & 1 & -m \\ -m & 1 & -m & 1 \\ mA & A & -mA & -A \end{bmatrix} \cdot \begin{bmatrix} A & 1 & m & -m\bar{A} \\ -mA & m & 1 & \bar{A} \end{bmatrix}$$

Rearranging the above by substituting $m = \sqrt{-1}$, the following equation is obtained:

$$\begin{bmatrix} 1 & \sqrt{2A} & A & 0 \\ \sqrt{2A} & 1 & 0 & -\bar{A} \\ -A & 0 & 1 & \sqrt{2a} \\ 0 & A & \sqrt{2A} & 1 \end{bmatrix} \quad (12)$$

and the crosstalk component becomes larger than the main component. In other words, the above equation shows that if the RMC decoder is held unchanged, the sound field of the RM signal cannot be reproduced.

By effecting the following matrix operation in connection with the equation (12), a 4-channel sound field can be reproduced.

$$\begin{bmatrix} 1000 \\ 0100 \\ 0001 \\ 0010 \end{bmatrix} \cdot \begin{bmatrix} 1 & \sqrt{2A} & A & 0 \\ \sqrt{2A} & 1 & 0 & -\bar{A} \\ -A & 0 & 1 & \sqrt{2A} \\ 0 & A & \sqrt{2A} & 1 \end{bmatrix} \cdot \begin{bmatrix} 0100 \\ 1000 \\ 0010 \\ 0001 \end{bmatrix} = \begin{bmatrix} \sqrt{2A} & 1 & A & 0 \\ 1 & \sqrt{2A} & 0 & -\bar{A} \\ A & 0 & \sqrt{2A} & 1 \\ 0 & -A & 1 & \sqrt{2A} \end{bmatrix} \quad (13)$$

The physical meaning of this operation lies in that the left front input signal $L_F$ is applied to the left rear input terminal 14; the left rear input signal $L_B$ is applied to the left front input terminal 11 of the RM encoder shown in FIG. 1; also the right front output signal $R_F'$ is applied to the right rear speaker; and the right rear output signal is applied to the right front speaker.

Only by changing the connection of output signals of RMC decoder, the unlocation of reproduced sound image will occur for the reason that front signals and rear signals are opposite phase side by side. A vector form of the equation (13) in the case of $\theta = 45°$ is such as depicted in FIG. 14.

The following table 1 summarizes the foregoing description given of the RMC system of this invention.

| signal / decoder | RM eq. (1) | CD-4 eq. (4) | RMC eq. (7) |
|---|---|---|---|
| RM eq. (2) | Yes S = 3dB eq. (3)Fig. 4 | No | Yes S = 3dB eq. (9)FIG. 11 |

-continued

| signal decoder | RM eq. (1) | CD-4 eq. (4) | RMC eq. (7) |
|---|---|---|---|
| CD-4 eq. (5) | No | Yes S = ∞ eq. (6) | Yes S = 7.7dB eq. (10)Fig. 12 |
| RMC eq. (8) | Yes(qualified) S = 3dB eq. (13)Fig. 14 | Yes S = 7.7dB eq. (11)Fig. 13 | Yes S = ∞ |

The designation "Yes" in the Table 1 shows such combinations of a signal to a decoder that multi-directional output signals are obtained to represent the ordinary sound field, and the designation "No" shows such combinations that ordinary reproduced signals are not obtained. In addition, the separation factor between the main and adjacent output signals in each combination are also shown with reference of the corresponding equations and figures in the foregoing description.

Inspection of the Table 1 will be shown that the novel RMC system has an appreciable compatibility for RM system and CD-4 system.

As will be apparent from the foregoing, the compatibility of the RMC and CD-4 systems are not always so satisfactory.

Therefore, the present inventor proposes an embodiment of the RMD system which has more excellent compatibility with the CD-4 system. This system will hereinafter be referred to as an RMT system.

Figure 15:
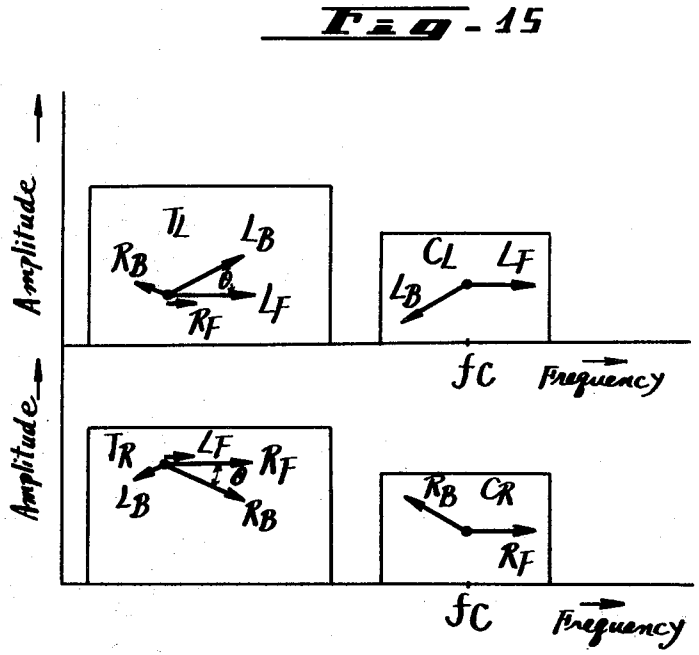
FIG. 15 illustrated the signal construction in encoding of an RMT system which is another example of this invention.

The RMT system signal construction is shown in FIG. 15. As will be seen from the figure, this signal is different from the RMC signal in that the left and right carrier signals $C_L$ and $C_R$ are composed only of the left side signals $L_F$ and $L_B$ and the right side signals $R_F$ and $R_B$ respectively.

Figure 21:
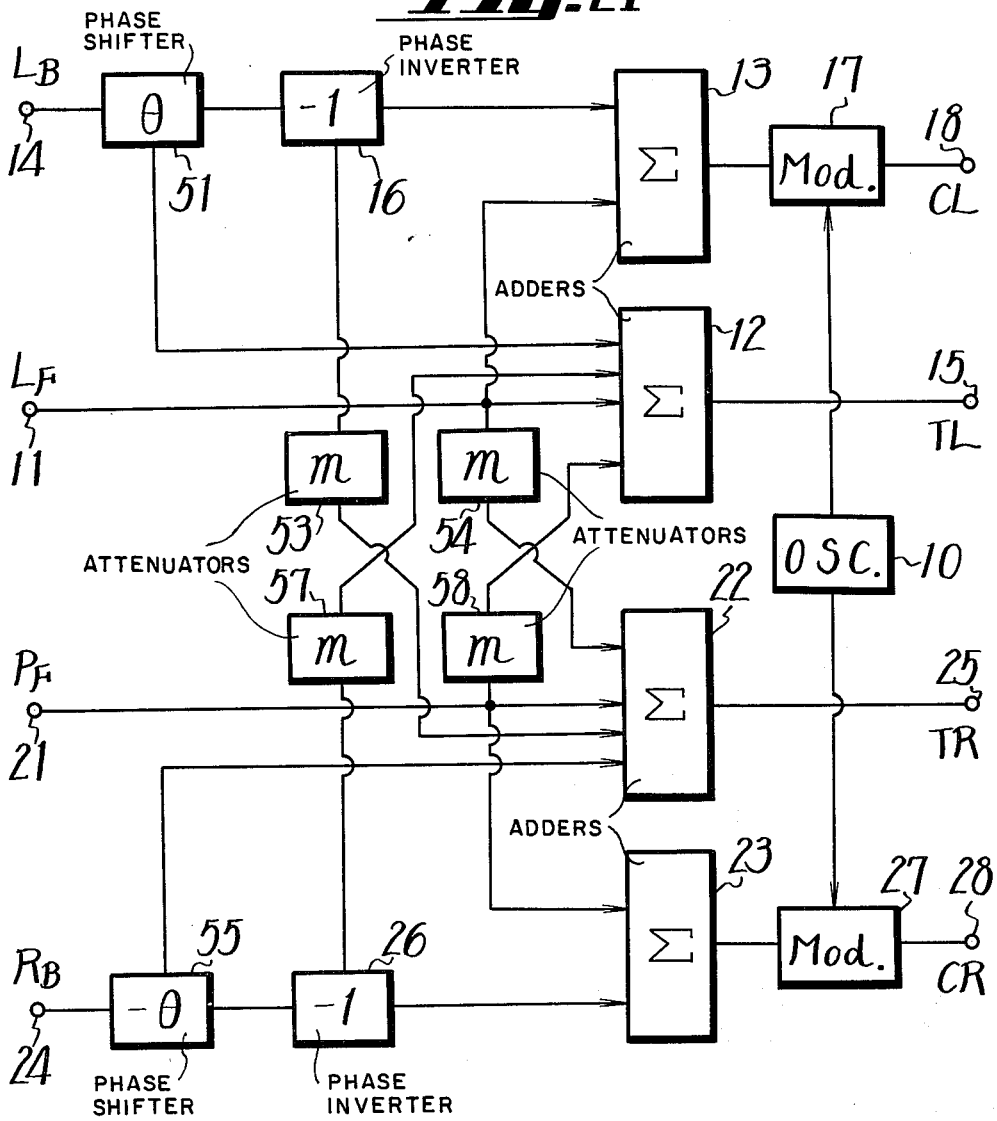
FIGS. 21 and 22 are block diagrams of the invention.

The encode of the RMT system is expressed in matrix form as follows:

$$\begin{pmatrix} T_L \\ T_R \\ C_L \\ C_R \end{pmatrix} = \begin{pmatrix} A & 1 & m & -m\bar{A} \\ -mA & m & 1 & \bar{A} \\ -A & 1 & 0 & 0 \\ 0 & 0 & 1 & -\bar{A} \end{pmatrix} \cdot \begin{pmatrix} L_B \\ L_F \\ R_F \\ R_B \end{pmatrix} \quad (14)$$

where $A = e^{j\theta}$ and $A = e^{-\theta}$. One embodiment of the RMT encoder based on the equation (14) is shown in FIG. 21. Its differences from the RMC encoder which is shown in FIG. 9 are that the connection between an input terminal 24 and an adder 13 is cutoff by removing an attenuator 56, and the connection between an attenuator 58 and an adder 13 is also cut off, for the reason of applying no right side signals $R_F$ and $R_B$ to an adder 13 which makes the left carrier signal $C_L$ therein, and similarly that an attenuator 52 is removed and the connection between an attenuator 54 and an adder 23 is cut off, for applying no left side signals $L_F$ and $L_B$ to an adder 23 which makes the right carrier signal $C_R$ therein.

The RMT system is capable of discrete reproduction and its decode matrix is a reverse matrix of the encode matrix of the equation (14) and it is as follows:

$$\begin{pmatrix} L_B' \\ L_F' \\ R_F' \\ R_B' \end{pmatrix} = \begin{pmatrix} \bar{A} & 0 & -\bar{A} & -M\bar{A} \\ 1 & 0 & 1 & -m \\ 0 & 1 & -m & 1 \\ 0 & A & -mA & -A \end{pmatrix} \cdot \begin{pmatrix} T_L \\ T_R \\ C_L \\ C_R \end{pmatrix} \quad (15)$$

Figure 22:
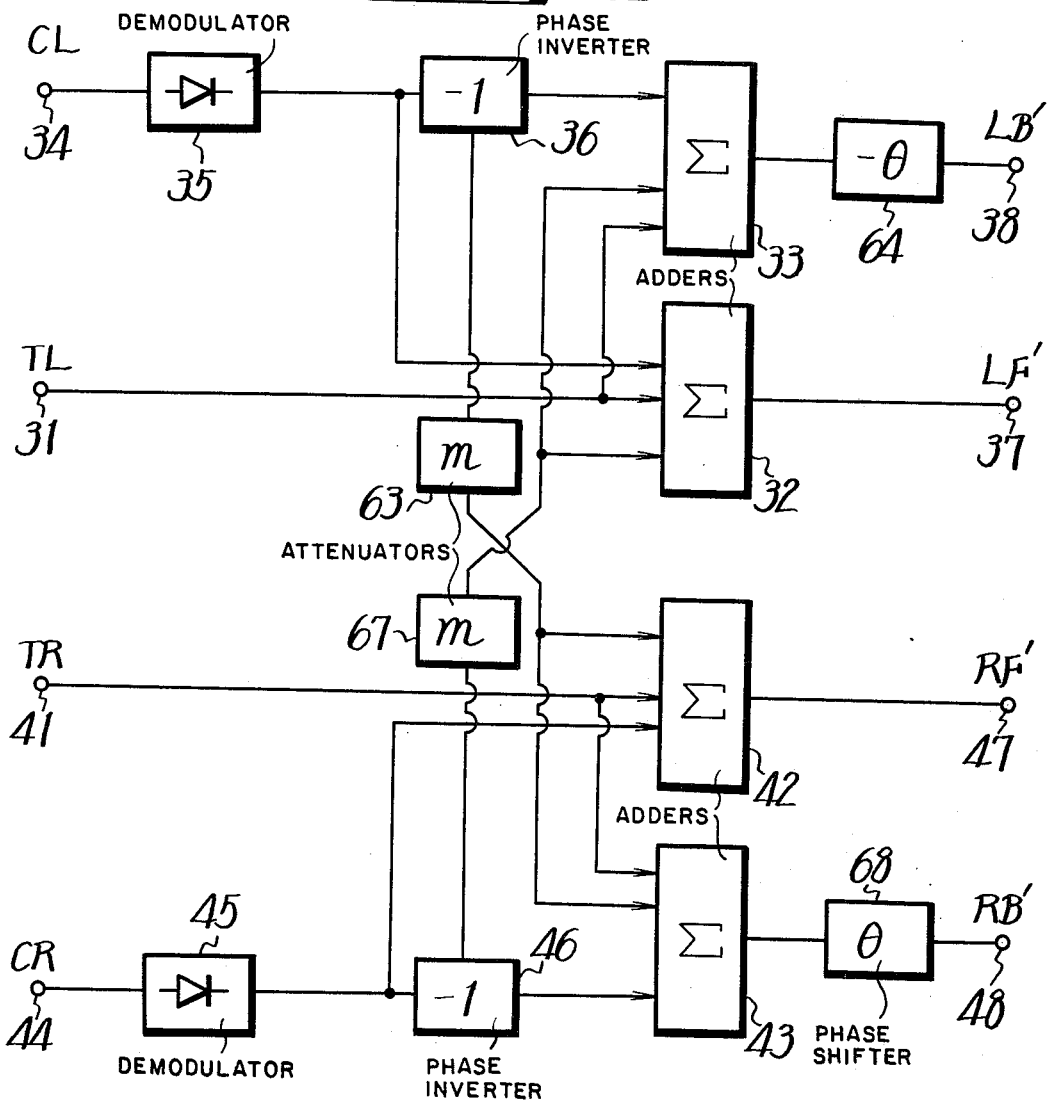

One embodiment of the RMT decoder based on the equation (15) is shown in FIG. 22. Its differences from the RMC decoder which is shown in FIG. 10 are that the connections between an input terminal 41 and the adders 32 and 33 are cut off by removing an attenuator 66 and a phase-inverter 61 for applying no right transmission signal $T_R$ to these adders 32 and 33 which make the left side output signal $L_F'$ and $L_B'$, and similarly that an attenuator 62 and a phase-inverter 65 are removed for applying no left transmission signal $T_L$ to the adders 42 and 43 which make the right side output signals $R_F'$ and $R_B'$.

It will readily be understood that in the case of applying the RMT signal to the RM decoder of the equation (2), exactly the same result as that described previously with regard to the RMC system is obtained because the transmission signals $T_L$ and $T_R$ of the RMT signal are identical with those of the RMC signal. Applying the RMT signal of the equation (14) to the CD-4 system decoder of the equation (5), the resulting output signal matrix is as follows:

$$\begin{pmatrix} 1 & 0 & -1 & 0 \\ 1 & 0 & 1 & 0 \\ 0 & 1 & 0 & 1 \\ 0 & 0 & 0 & -1 \end{pmatrix} \cdot \begin{pmatrix} A & 1 & m & -m\bar{A} \\ -mA & m & 1 & \bar{A} \\ -A & 1 & 0 & 0 \\ 0 & 0 & 1 & -\bar{A} \end{pmatrix} = \begin{pmatrix} 2A & 0 & m & -m\bar{A} \\ 0 & 2 & m & -m\bar{A} \\ -mA & m & 2 & 0 \\ -mA & m & 0 & 2\bar{A} \end{pmatrix} \quad (16)$$

Figure 16A:
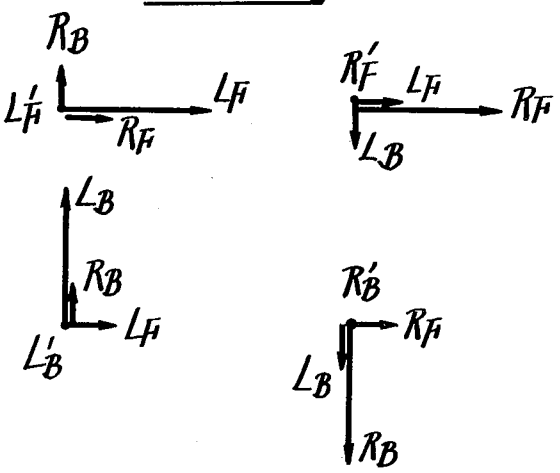
FIGS. 16A and 16B show a series of reproduced signal vector diagrams of RMT signals by the CD-4 decoder.
Figure 16B:
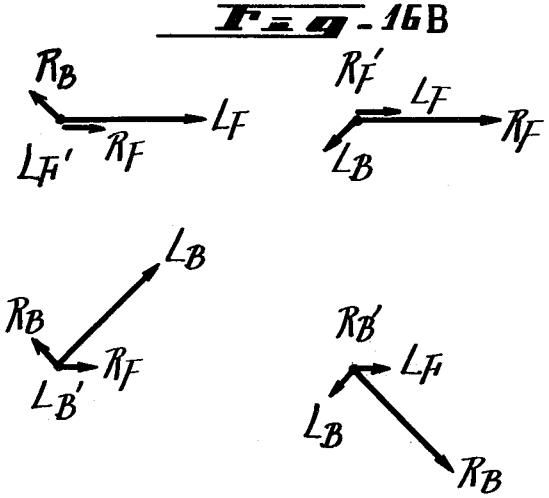

Shown in vector form in the case of $\theta = 90°$, the above is such as depicted in FIG. 16A in which $L_B$ and $R_B$ output signals are opposite in phase to each other. In order to make them in phase with the front signals for the sound image location, they must be further delayed and advanced 90° respectively. In the case of $\theta = 45°$, the phase difference between the both rear signals is 90° as shown in FIG. 16B. With respect to the usual value of $m = \sqrt{2} - 1$, separation is 13.7dB and practically satisfactory 4-channel effect can be obtained.

Applying the CD-4 signal of the equation (4) to the RMT decoder of the equation (15), the resulting output signal matrix is as follows:

$$\begin{pmatrix} \bar{A} & 0 & -\bar{A} & -m\bar{A} \\ 1 & 0 & 1 & -m \\ 0 & 1 & -m & 1 \\ 0 & A & -mA & -A \end{pmatrix} \cdot \begin{pmatrix} 1 & 1 & 0 & 0 \\ 0 & 0 & 1 & 1 \\ -1 & 1 & 0 & 0 \\ 0 & 0 & 1 & -1 \end{pmatrix} = \begin{pmatrix} 2\bar{A} & 0 & -m\bar{A} & m\bar{A} \\ 0 & 2 & -m & m \\ m & -m & 2 & 0 \\ mA & -mA & 0 & 2A \end{pmatrix} \quad (17).$$

Figure 17A:
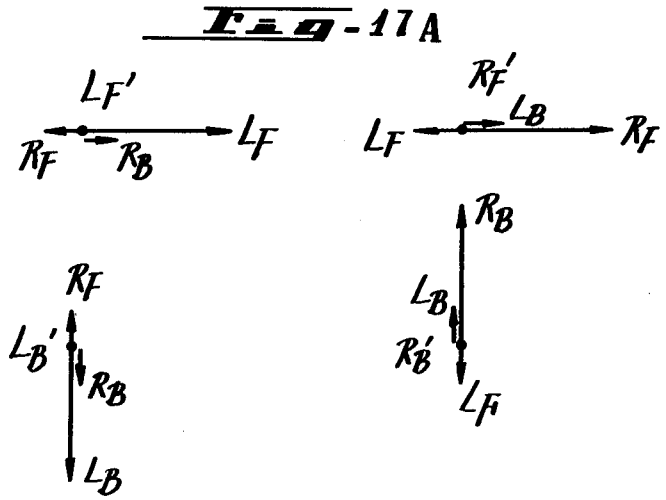
FIGS. 17A and 17B show a series of reproduced signal vector diagrams of CD-4 signals by an RMT decoder.
Figure 17B:
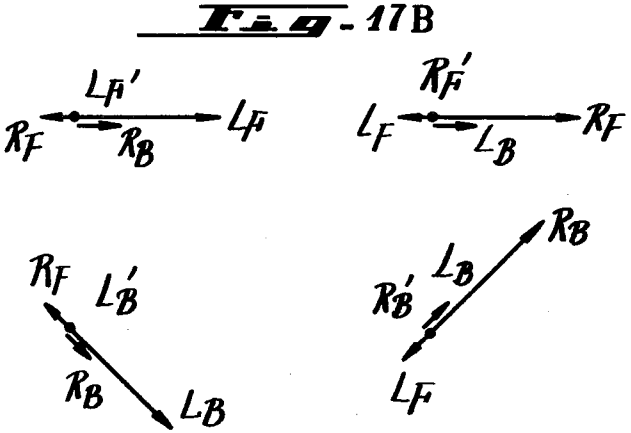

Shown in vector form in connection with the case of $\theta = 90°$, the rear signals $L_B$ and $R_B$ are opposite in phase to each other as depicted in FIG. 17A. In order to make them in phase with the front signals for sound image location, they must be further delayed and advanced 90° respectively. In the case of $\theta = 45°$, the phase difference between the above both signals is 90° as shown in FIG. 17B and, with respect to the usual value $(\sqrt{2} - 1)$ of $m$, separation is 13.7dB and the 4-channel effect is practically satisfactory. Since the RMT system is discrete as is the case with the aforesaid RMC system, it will easily be seen that the overall matrix of the RMT encode.CD-4 decode, given by the equation (16) and the overall matrix of the CD-4 encode. RMT decode, given by the equation (17), are reverse matrix, which is a correction matrix necessary in the case of the RMT (90°). Even by applying the RM signal of the equation (1) to the RMT decoder of the equation (15), no original sound field can be reproduced.

The foregoing can be summarized as given by the following table 2.

| signal / decoder | RM eq. (1) | CD-4 eq. (4) | RMT eq. (14) |
|---|---|---|---|
| RM eq. (2) | Yes S = 3dB eq. (3)Fig. 4 | No | Yes S= 3dB eq. (9)Fig. 11 |
| CD-4 eq. (5) | No | Yes S = ∞ eq. (6) | Yes S = 13.7dB eq. (16)Fig. 16 |
| RMT eq. (15) | No | Yes S = 13.7dB eq. (17)Fig. 17 | Yes S = ∞ |

The similar expressions such as in Table 1 are used in this Table 2, and the inspection of Table 2 will be shown that the novel RMT system has a satisfactory compatibility for RM and CD-4 systems.

As has repeatedly been described in the foregoing, the RMD system of this invention is a novel discrete 4 channel system based on the regular matrix system.

If attention is paid only to the signal conversion at the time of encoding and decoding in the RM system, mathematic theories can well be applied. However, it is known that in the case of forming a sound field by the reproduced signals, front left and right sound images are displaced inwardly due to the directive characteristic of the sense of hearing and compensating for the displacement is often achieved by selecting the value of the distribution ratio m to be, for example, about 0.3 and about 0.5 with respect to the front and rear signals respectively.

By selecting the distribution ratio m of the transmission signals $T_L$ and $T_R$ as mentioned above for the compensation for the displacement due to the sense of hearing in connection with the RMD signal, it is possible to obtain signals for correct sound image location in the case of RM reproduction.

However, by RMC reproduction of, for example, the RMC (90°) signal thus compensated, the following equation is obtained from the both equations (7) and (8):

$$\begin{pmatrix} -j & -0.4j & j & 0.4j \\ 1 & -0.4 & 1 & -0.4 \\ -0.4 & 1 & -0.4 & 1 \\ 0.4j & j & -0.4j & -j \end{pmatrix} \cdot \begin{pmatrix} j & 1 & 0.3 & 0.5j \\ -0.5j & 0.3 & 1 & -j \\ -j & 1 & 0.4 & -0.4j \\ 0.4j & 0.4 & 1 & j \end{pmatrix} = \begin{pmatrix} 1.64 & 0.04j & 0.1j & -0.1j \\ 0.04j & 1.72 & -0.1 & -0.1j \\ -0.1j & -0.1 & 1.72 & 0.04j \\ -0.1j & -0.1j & 0.04j & 1.64 \end{pmatrix}$$

It will be apparent that, in connection with the respective main components, the front signals are displaced outwardly to make it impossible to provide a faithful sound field.

In both the RM and the discrete reproduction, accoustic-psychologically correct reproduced sound images can be obtained by subjecting the components of the two carrier signals $C_L$ and $C_R$ to compensation reverse to that for the two transmission signals $T_L$ and $T_R$ effected at the time of encoding. Namely, in the encoding of the carrier signals $C_L$ and $C_R$, the distribution ratio m to the front signals is selected to be, for example, 0.5 and that to the rear signals is selected to be, for example, 0.3. This is shown in matrix form as follows:

$$\begin{pmatrix} T_L \\ T_R \\ C_L \\ C_R \end{pmatrix} = \begin{pmatrix} j & 1 & 0.3 & 0.5j \\ -0.5j & 0.3 & 1 & -j \\ -j & 1 & 0.5 & -0.3j \\ 0.3j & 0.5 & 1 & j \end{pmatrix} \cdot \begin{pmatrix} L_B \\ L_F \\ R_F \\ R_B \end{pmatrix}$$

The overall matrix combinated with the aforesaid RMC decoder is as follows:

$$\begin{bmatrix} 1.68 & 0.08j & 0.2j & 0 \\ 0.08j & 1.68 & 0 & 0.2j \\ -0.2j & 0 & 1.68 & -0.08j \\ 0 & -0.2j & -0.08j & 1.68 \end{bmatrix}$$

Thus, correct reproduced sound field is obtained. Further, crosstalk on a diagonal line is 18.5dB and does not matter in practice.

Even by making the above compensation of the both transmission signals in connection with the RMT signal, a correct sound field can be obtained with the RMC decoder.

As has been clarified by the foregoing description of the RMD system of this invention, under particular condition such as $\theta = 90°$, the rear sound images are not located during reproducing and it might not be said that this system is sufficiently compatible with the existing CD-4 system. This present a problem particularly in the decoding, so that the present inventor purposes an improved RMD decoding system. The following will describe the RMT system.

If the amount of phase shift of the RMT decoder is taken as $\theta$, its decode matrix is expressed in the following form in accordance with the aforesaid equation (15):

$$\begin{bmatrix} \overline{B} & 0 & -\overline{B} & -n\overline{B} \\ 1 & 0 & 1 & -n \\ 0 & 1 & -n & 1 \\ 0 & B & -nB & -B \end{bmatrix}$$

where $B = e^{j\phi}$, $\overline{B} = e^{-j\phi}$ and n is the distribution ratio, $0<n<1$. The overall matrix of the RMT encode matrix given by the equation (14) and the above decode matrix is as follows:

$$\begin{bmatrix} \overline{B} & 0 & -\overline{B} & -n\overline{B} \\ 1 & 0 & 1 & -n \\ 0 & 1 & -n & 1 \\ 0 & B & -nB & -B \end{bmatrix} \cdot \begin{bmatrix} A & 1 & m & -m\overline{A} \\ -mA & m & 1 & \overline{A} \\ -A & 1 & 0 & 0 \\ 0 & 0 & 1 & -\overline{A} \end{bmatrix}$$

$$= \begin{bmatrix} 2\overline{AB} & 0 & (m-n)\overline{B} & (n-m)\overline{AB} \\ 0 & 2 & m-n & (n-m)\overline{A} \\ (n-m)A & m-n & 2 & 0 \\ (n-m)AB & (m-n)B & 0 & 2\overline{A}B \end{bmatrix}$$

and the phase difference between the left and right rear output signals is as follows:

$$(\theta - \phi) - (\phi - \theta) = 2(\theta - \phi)$$

Applying the CD-4 signal to the RMT ($\phi$) decoder, the resulting reproduced signal is obtained in matrix form from the equation (17) as follows:

$$\begin{bmatrix} 2\overline{B} & 0 & -n\overline{B} & n\overline{B} \\ 0 & 2 & -n & n \\ n & -n & 2 & 0 \\ nB & -nB & 0 & 2B \end{bmatrix}$$

and the phase difference between the left and right rear output signals is as follows:

$$-\phi-\phi=-2\phi$$

Figure 18:
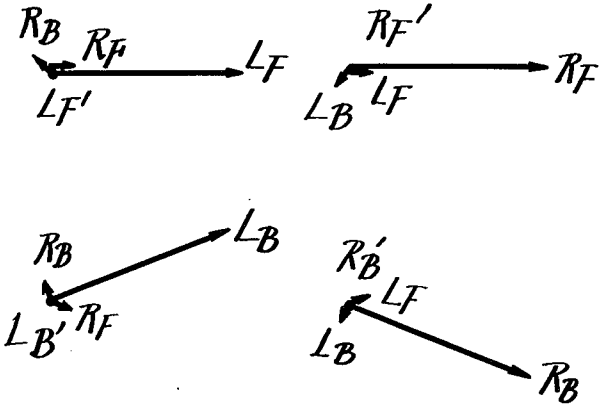
FIG. 18 shows a series of reproduced signal vector diagrams of the RMT signal by an improved RMT decoder.
Figure 19:
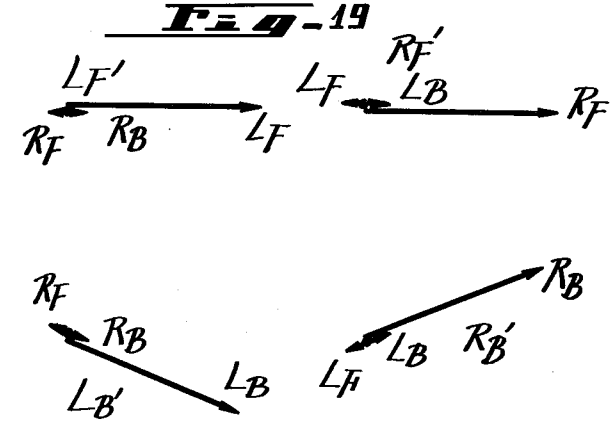
FIG. 19 shows a series of reproduced signal vector diagrams of the CD-4 signal by the improved RMT decoder.

A decrease in the amount of signal phase shift $\phi$ of the RMT ($\phi$) decoder decreases the phase difference between the rear output signals with respect to the CD-4 signal to enhance the compatibility but, at the same time, excellent compatibility is required for the RMT ($\phi$) signal. In order that the phase differences between the rear output signals of the both systems may be equal to each other, it is sufficient only to obtain the following relation:

$$\theta = 2\phi$$

and in order that separations of the both system signals may be equal to each other, it is sufficient only that the following relation holds:

$$m = 2n$$

$$\theta = 45°, \phi = 22.5°$$

$$m = \sqrt{2} - 1, n = \frac{\sqrt{2}-1}{2}$$

the reproduced outputs of the RMT ($\theta$) and CD-4 signals by the RMT ($\theta$) decoder of this invention are such as shown in vector form in FIGS. 18 and 19, from which it will be seen that the location of the rear sound images is improved. Further, the separations are both 19.7dB, so that the both reproduced signals are substantially discrete.

The improved decode system has been described as being applied to the RMT system but it will readily be understood from the similarity of the RMT and RMC systems that substantially the same discussion as that given above can be applied to the RMC system. If $m = 0.4$ and if $n = 0.2$, the separation is about 13.3dB during reproducing of the RMC signal and about 14dB during reproducing of the CD-4 signal and these values are sufficient in practice for the 4-channel reproduction.

It is easy for those skilled in the art to apply the concept of this invention to matrix multiplex sound systems ether than the regular matrix system. For example, matrix form of the Scheiber-type RMC system is expressed in the following form:

$$\begin{bmatrix} T_L \\ T_R \\ C_L \\ C_R \end{bmatrix} = \begin{bmatrix} 1 & 1 & m & -m \\ -m & m & 1 & 1 \\ -1 & 1 & m & m \\ m & m & 1 & -1 \end{bmatrix} \cdot \begin{bmatrix} L_B \\ L_F \\ R_F \\ R_B \end{bmatrix}$$

-continued $$\begin{bmatrix} L_B' \\ L_F' \\ R_F' \\ R_B' \end{bmatrix} = \begin{bmatrix} 1 & m & -1 & -m \\ 1 & -m & 1 & -m \\ -m & 1 & -m & 1 \\ m & 1 & -m & -1 \end{bmatrix} \cdot \begin{bmatrix} T_L \\ T_R \\ C_L \\ C_R \end{bmatrix}$$

Rearranging the two equations, the overall matrix becomes as follows:

$$\begin{bmatrix} 2(1-m^2) & 0 & 0 & 0 \\ 0 & 2(1-m^2) & 0 & 0 \\ 0 & 0 & 2(1-m^2) & 0 \\ 0 & 0 & 0 & 2(1-m^2) \end{bmatrix}$$

From this, it appears that discrete reproducing is effected.

Applying the CD-4 signal to a Scheiber base decoder, the resulting output signal matrix is as follows:

$$\begin{bmatrix} 1 & m & -1 & -m \\ 1 & -m & 1 & -m \\ -m & 1 & -m & 1 \\ m & 1 & -m & -1 \end{bmatrix} \cdot \begin{bmatrix} 1 & 1 & 0 & 0 \\ 0 & 0 & 1 & 1 \\ -1 & 1 & 0 & 0 \\ 0 & 0 & 1 & -1 \end{bmatrix}$$

$$= \begin{bmatrix} 2 & 0 & 0 & 2m \\ 0 & 2 & -2m & 0 \\ 0 & -2m & 2 & 0 \\ 2m & 0 & 0 & 2 \end{bmatrix}$$

If $m = 0.2$ in the RCM decoder, the amount of crosstalk is $-14$dB. The overall matrix in the case of crosstalk of the Scheiber-type signal ($m = 0.4$) to the decoder with $m = 0.2$ in accordance with the above calculation is as follows:

$$\begin{bmatrix} 1.84 & 0 & 0 & -0.4 \\ 0 & 1.84 & 0.4 & 0 \\ 0 & 0.4 & 1.84 & 0 \\ -0.4 & 0 & 0 & 1.84 \end{bmatrix}$$

Thus, the crosstalk is $-13.8$dB. In either case, the separation is sufficient in practice.

The RMD system of this invention is based on the conventional regular matrix system but a correct reproduced sound field cannot be obtained from the RM signal as described previously and, in some cases, the RM signal can be reproduced only by exchanging the connection of the inputs of RM encoder and the connection of the output signals of the RMC.

Accordingly, for reproducing the RM signal, it is necessary to change over the connections of input and output terminals of the RMD decoder or the decoding matrix.

The present inventor has noticed that the difference between the two systems depends on the presence or absence of the carrier signal and proposes a decoder for detecting it and automatically changing over the decoding matrix. With reference to the drawings, its example will hereinbelow be described.

Figure 20:
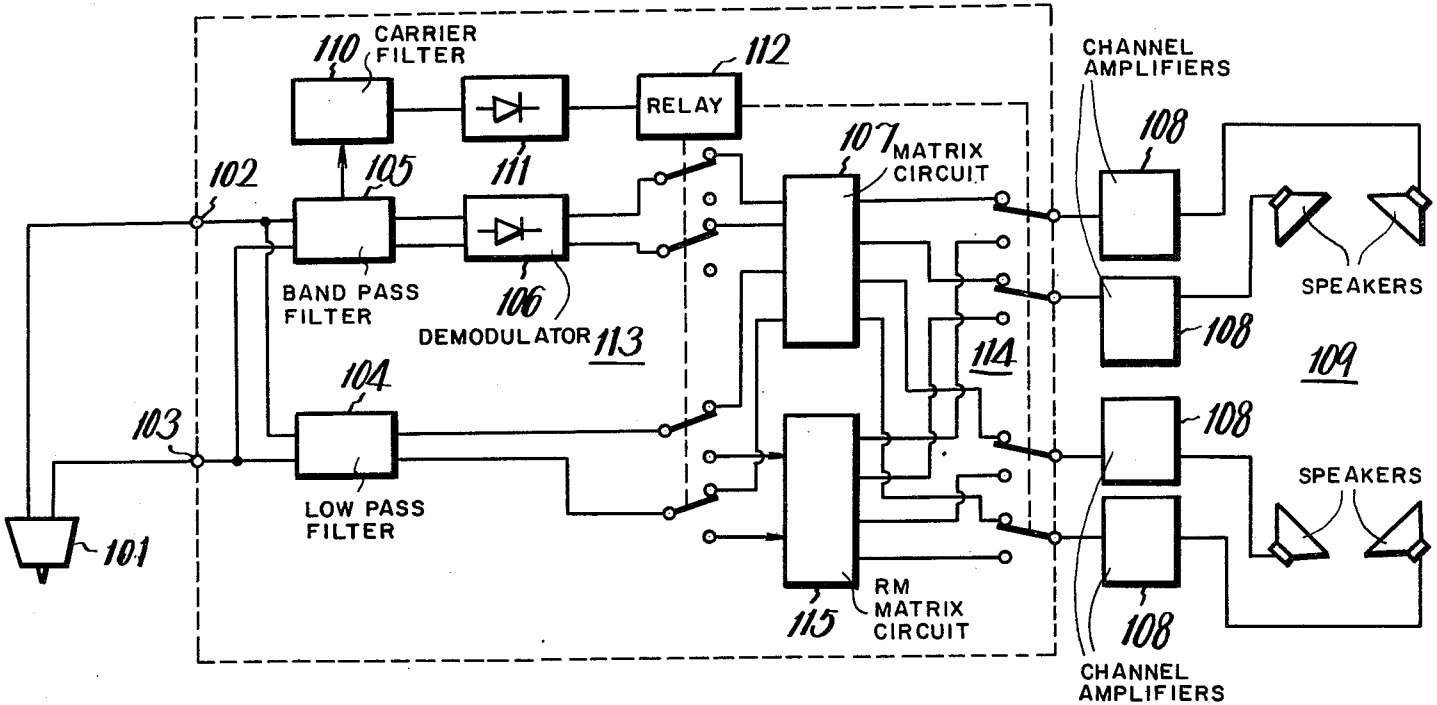
FIG. 20 is a block diagram illustrating one example of an automatic switching device actuable for selecting the decoder for this invention or the RM recoder.

In FIG. 20, left and right track signals reproduced by a pickup 101 are applied through input terminals 102 and 103 to a low-pass filter 104 and a bandpass filter 105 having predetermined band widths respectively. The low-pass filter 104 derives therefrom the left and right transmission signals $T_L$ and $T_R$, while the bandpass filter 105 derives therefrom the left and right carrier signals $C_L$ and $C_R$. The carrier signals are demodulated by a demodulator 106 into third and fourth transmission signals $T_3$ and $T_4$. These four transmission signals are applied through a switch 113 to a discrete signal matrix circuit 107. In the matrix circuit 107, the four transmission signals $T_L$, $T_R$, $T_3$ and $T_4$ are combined as expressed by the aforesaid equation (8) or (8.1) to provide four reproduced signals $L_B'$, $L_F'$, $R_F'$ and $R_B'$. The signals $L_B'$, $L_F'$, $R_F'$ and $R_B'$ thus obtained are applied through a switch 114 to a 4-channel amplifier 108 to be thereby amplified, thereafter being supplied to their corresponding speakers 109 to reproduce the 4-channel sound field.

One portion of each of the left and right carrier signals $C_L$ and $C_R$ separated by the bandpass filter 105 is fed to a carrier filter 110 of narrow band to provide the carrier fc, which is detected by a detector 111, the output of which is applied to a switch drive means 112 such, for example, as a relay. In the presence of the detected output, that is, the carrier signal, the switch drive means 112 actuates ganged switches 113 and 114 so that the outputs from the low-pass filter 104 and the demodulator 106 may be connected to the discrete matrix circuit 107 and that the output from the matrix circuit 107 may be fed to the 4-channel amplifier 108. Further, in the absence of the carrier, the switch drive means 112 actuates the ganged switches 113 and 114 so that the output from the low-pass filter 104 may be supplied to an RM matrix circuit 115 and that the output from the RM matrix circuit 115 may be fed to the 4-channel amplifier 108.

With the present invention, the output signal from the pickup is automatically supplied to the decode matrix circuit of the system corresponding to whether the output signal contains the carrier or not, that is, whether the output signal is of the discrete or RM system. Accordingly, the user need not judge the recording system of the program source and can enjoy the 4-channel stereo effect in the reproduced sound field corresponding to the system employed.

It will be apparent to those skilled in the art that many modifications and variations may be effected without departing from the scope of the novel concept of this invention and that this invention can immediately applied to the CD-4 system. For example, it is possible to reproduce a pseudo-sound field by decreasing crosstalk by applying the output of the RM matrix circuit 115 to a logic circuit.

As has been described in the foregoing, this invention is a novel discrete system which is compatible with both of the conventional matrix and discrete systems and one kind of program source according to this invention system sufficiently exhibits the 4-channel stereo effect not only in the reproducer of this invention but also in those of the RM and CD-4 systems, so that the present invention has a great advantage that the program source is not limited by the reproducer. Further, since the reproducer of this invention system sufficiently provides the 4-channel effect with respect to signals of not only this invention system but also the RM and CD-4 systems, this eliminates the necessity of selecting the reproducer according to the signal system used and hence simplifies the construction of the reproducer, which are great advantages in practice.

Further, this invention has an advantage that by appropriate compensation of the distribution ratios of the front and rear signals at the time of encoding, the same encoding system provides accoustic-psychologically correct sound image location for both of the RM and discrete reproduction, so that the reproducing system need not be taken into account.

Moreover, by selecting the combination ratio of the RMD decoder of this invention to be about ½ of that of RMD encoder, the same RMD encoder can be used for the CD-4 signal with sufficiently compatibility therewith. In addition, if the amount of signal phase shift of the RMD decoder is set in the middle of the amount of signal phase shift of the RMD encoder, the RMD signal and the CD-4 signal can be both reproduced by the same decoder with sufficient 4-channel effect and there is no need of change the decoder in accordance with the encoding system used and, further, the design of the apparatus can be simplified.

I claim as my invention:

1. A multichannel audio signal recording and reproducing system comprising:

(a) means for encoding four input audio information signals designated as $L_F$, $L_B$, $R_F$ and $R_B$ to produce first and second transmission signals $T_L$ and $T_R$ and first and second carrier signals $C_L$ and $C_R$; and (b) means for recording said first and second transmission signals $T_L$ and $T_R$ and said first and second carrier signals $C_L$ and $C_R$ on a recording medium having first and second channels each of which has an audio frequency band for a transmission signal and a carrier frequency band for a modulated carrier signal, respectively, wherein said first and second transmission signals $T_L$ and $T_R$ and said first and second carrier signals $C_L$ and $C_R$ are related to four input audio information signals according to the following equations:

$$T_L = A_{LB} + L_F + mR_F - m\bar{A}R_B$$

$$T_R = -mAL_B + mL_F + R_F + \bar{A}R_B$$

$$C_L = -AL_B + L_F + 0\,mR_F + m\bar{A}R_B$$

$$C_R = mAL_B + mL_F + R_F - \bar{A}R_B$$

where $A = e^{j\theta}$, $\bar{A} = e^{-j\theta}$, $O < m < 1$ and $O \leqq \theta \leqq 90°$, L = left, R = right, F=front, B = back, T = transmission and C = carrier.

2. A multichannel sound signal reproducing system, comprising:

(a) means for reproducing four discrete audio information signals designated as $L_F$, $L_B$, $R_F$ and $R_B$ from first and second transmission signals $T_L$ and $T_R$ and first and second carrier signals $C_L$ and $C_R$ which are recorded according to claim 1; wherein said four discrete audio information signals $L_F$, $L_B$, $R_F$ and $R_B$ are related to said first and second transmission signals $T_L$ and $T_R$ and first and second carrier signals $C_L$ and $C_R$ according to the following equations:

$$L_F' = \bar{A}T_L + m\bar{A}T_R - \bar{A}C_L - m\bar{A}C_R$$

$$L_B' = T_L - mT_R + C_L - mC_R$$

$$R_F' = -mT_C + T_R = mC_L + C_R$$

$$R_B' = mAT_L + AT_R - mAC_L - AC_R$$

where $\bar{A} = e^{j\theta}$, $0 < m < 1$ and $0 < \theta < 90°$, L = left, R = right, F = front, B = back, T = transmission and C = carrier.

3. A multichannel sound signal reproducing system, comprising:

(a) means for reproducing four discrete audio information signals designated as $L_F$, $L_{B'}$, $R_F$ and $R_{B'}$ from first and second transmission signals $T_L$ and $T_R$ and first and second carrier signals $C_L$ and $C_R$ which are recorded according to claim 1; wherein said four discrete audio information signals $L_F$, $L_B$, $R_F$ and $R_B$ are related to said first and second transmission signals $T_L$ and $T_R$ and first and second carrier signals $C_L$ and $C_R$ according to the following equations:

$$L_B' = \overline{A}T_L - \overline{A}C_L - m\overline{A}C_R$$

$$L_F' = T_L + C_L - mC_R$$

$$R_F' = T_R - mC_L + C_R$$

$$R_B' = AT_R - mAC_L - AC_R.$$

* * * * *